US007722379B2

(12) United States Patent
Yang et al.

(10) Patent No.: US 7,722,379 B2
(45) Date of Patent: May 25, 2010

(54) QUICK RELEASE CONNECTOR DEVICE

(75) Inventors: Chung Ta Yang, Taipei Hsien (TW); Meng Chieh Wu, Taipei Hsien (TW)

(73) Assignee: Aliner Industries, Inc., Sinjhuang, Taipei Hsien (TW)

( * ) Notice: Subject to any disclaimer, the term of this patent is extended or adjusted under 35 U.S.C. 154(b) by 66 days.

(21) Appl. No.: 12/221,000

(22) Filed: Jul. 30, 2008

(65) Prior Publication Data

US 2010/0029118 A1 Feb. 4, 2010

(51) Int. Cl.
*H01R 13/627* (2006.01)

(52) U.S. Cl. ..... 439/352; 439/578

(58) Field of Classification Search ..... 439/352, 439/578–385, 349–350
See application file for complete search history.

(56) References Cited

U.S. PATENT DOCUMENTS 6,142,812 A * 11/2000 Hwang ..... 439/352
6,645,011 B2 * 11/2003 Schneider et al. ..... 439/607.17
6,695,636 B2 * 2/2004 Hall et al. ..... 439/352
6,709,289 B2 3/2004 Huber et al. ..... 439/578
6,848,931 B2 * 2/2005 McMullen et al. ..... 439/350
7,238,047 B2 * 7/2007 Saettele et al. ..... 439/578
7,329,139 B2 * 2/2008 Benham ..... 439/352
7,351,088 B1 * 4/2008 Qu ..... 439/352

* cited by examiner

*Primary Examiner*—Xuong M Chung-Trans
(74) *Attorney, Agent, or Firm*—Charles E. Baxley

(57) ABSTRACT

A connector device includes a ferrule, a receptacle having a housing on one end and fitted in the ferrule for receiving an insulating member, a sealing ring fitted in the housing and engaged with the housing, a sleeve fitted in the ferrule and engaged with the housing and having a peripheral lip to engage with the sealing ring, a locking ring attached to the sleeve and having a number of blades, and an actuating member attached to the ferrule and having an actuator for moving the blades radially and for allowing a swelling of a tubular member to be moved over the blades and for allowing two connector element to be quickly coupled together and to be quickly disengaged from each other when required.

8 Claims, 7 Drawing Sheets

QUICK RELEASE CONNECTOR DEVICE

BACKGROUND OF THE INVENTION

1. Field of the Invention

The present invention relates to a connector device, and more particularly to a quick release connector device including two connector elements to be quickly coupled together and to be quickly disengaged from each other when required.

2. Description of the Prior Art

Typical connector devices, such as electrical plug connectors, coaxial connectors, etc., comprise two connector elements to be selectively plugged or coupled together for electrically connecting or coupling two conductors together, and to be selectively disengaged from each other when required.

For example, U.S. Pat. No. 6,709,289 to Huber et al. discloses one of the typical electrical plug connectors also comprising a first connector element and a second connector element to be connected or coupled together by means of a coupling member, and the connector elements each include an outer conductor and an inner conductor, and the coupling member is attached to the first connector element and includes a locking ring for engaging with the second connector element and for solidly coupling the two connector elements together.

However, after the locking ring is engaged with the second connector element, it will be difficult to disengage the locking ring from the second connector element such that the two connector elements may not be easily and quickly disengaged from each other when required. In addition, the sealing ring engaged between the two connector elements may not be stably retained in place and may be moved relative to the two connector elements such that an air or water tight seal may not be suitably formed between the two connector elements. Furthermore, the coupling member includes a complicated structure that may not be easily and quickly manufactured.

The present invention has arisen to mitigate and/or obviate the afore-described disadvantages of the conventional electrical plug connectors.

SUMMARY OF THE INVENTION

The primary objective of the present invention is to provide a connector device including two connector elements to be quickly coupled together and to be quickly disengaged from each other when required.

In accordance with one aspect of the invention, there is provided a connector device comprising a first connector element including a ferrule having a chamber formed therein, and having a first end portion and a second end portion, a receptacle having a compartment formed therein, and having a housing provided on one end portion thereof, and having a space formed in the housing, the housing being fitted within the chamber of the ferrule, an insulating member received and fitted in the compartment of the receptacle and including a bore formed in the insulating member, a sealing ring fitted in the space of the housing and engaged with the housing and the receptacle, a sleeve received and fitted in the chamber of the ferrule and engaged with the housing for anchoring and retaining the housing within the chamber of the ferrule, and including a peripheral lip extended from a first end portion of the sleeve to engage with the sealing ring and to anchor and retain the sealing ring between the housing and the sleeve, and the sleeve including a second end portion, a locking ring attached to the second end portion of the sleeve and including a number of blades extended therefrom and inclined relative to the sleeve, and an actuating member attached to the second end portion of the ferrule, and including an actuator extended radially therefrom for engaging with the blades of the locking ring and for anchoring and retaining the sleeve and the housing within the chamber of the ferrule, and a second connector element including a tubular member engaged into the sleeve and engageable with the receptacle for limiting the tubular member to move relative to the receptacle, and engaged with the sealing ring, the tubular member including a swelling extended radially and outwardly therefrom for engaging with the blades and for allowing the swelling to be moved over the blades and for allowing the blades to selectively engage with the swelling of the tubular member and to latch and anchor the tubular member to the receptacle and the sleeve, and the ferrule and the actuating member are movable relative to the sleeve and the housing to actuate the actuator of the actuating member to move the blades radially and outwardly relative to the tubular member and to allow the swelling of the tubular member to be moved over the blades and to allow the tubular member to be selectively disengaged from the sleeve and the housing of the first connector element.

The ferrule includes a peripheral flange extended radially and inwardly from the first end portion of the ferrule for engaging with the housing and for limiting the ferrule to move relative to the housing.

The housing includes an outer diameter greater than that of the receptacle for forming an outer peripheral shoulder between the housing and the receptacle and for engaging with the peripheral flange of the ferrule.

The housing includes an extension extended outwardly therefrom and having a hole formed in the extension and aligned with the bore of the insulating member. The sleeve includes a peripheral depression formed in the second end portion of the sleeve for attaching the locking ring.

The ferrule includes a peripheral recess formed in the second end portion of the ferrule for attaching the actuating member. The locking ring includes an inclined surface formed in a free end portion of each of the blades for engaging with swelling of the tubular member.

The tubular member includes a peripheral recess formed in an outer peripheral portion thereof and located beside the swelling for receiving and engaging with the blades of the locking ring.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
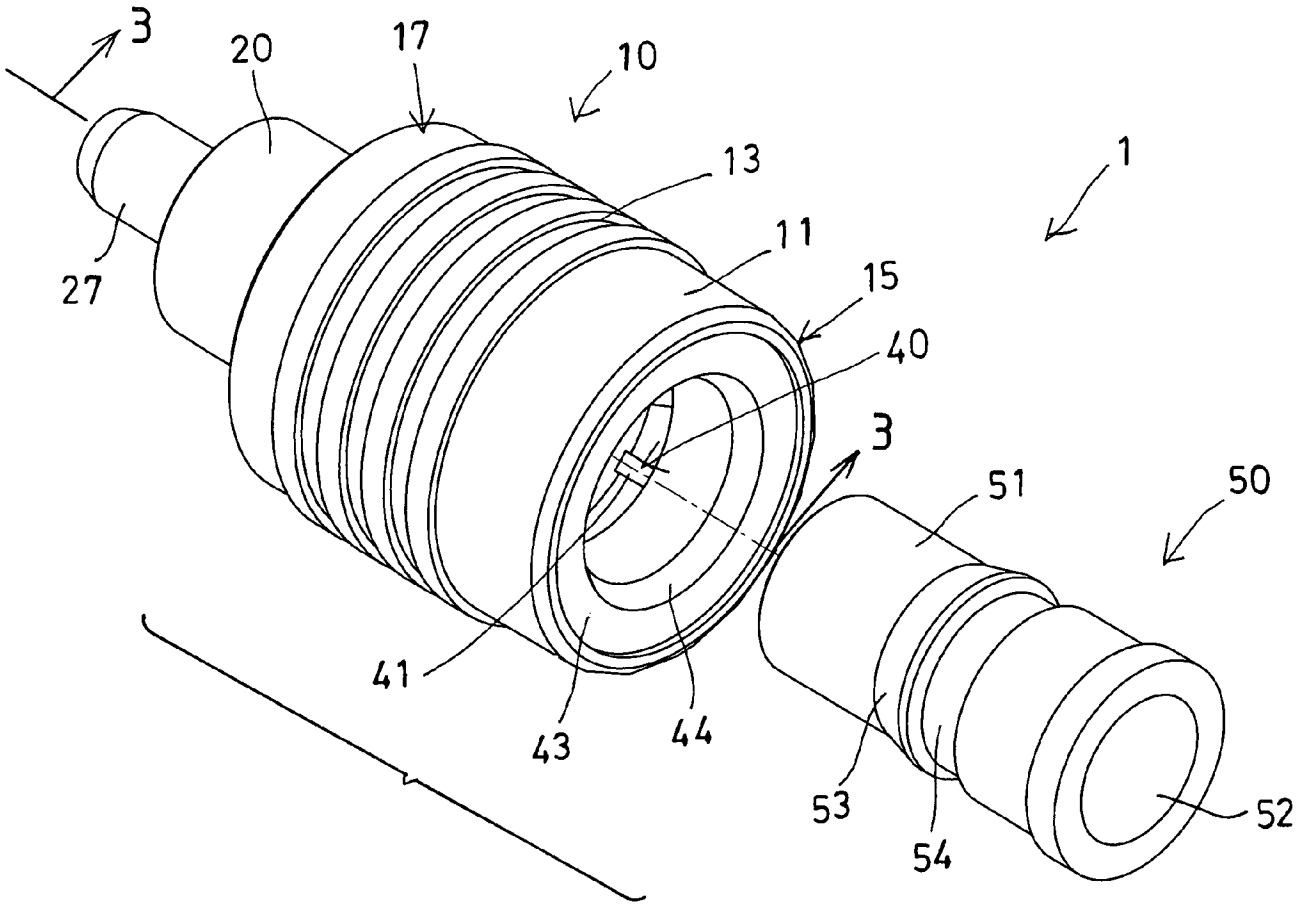
FIG. 1 is a partial exploded view of a connector device in accordance with the present invention.
Figure 2:
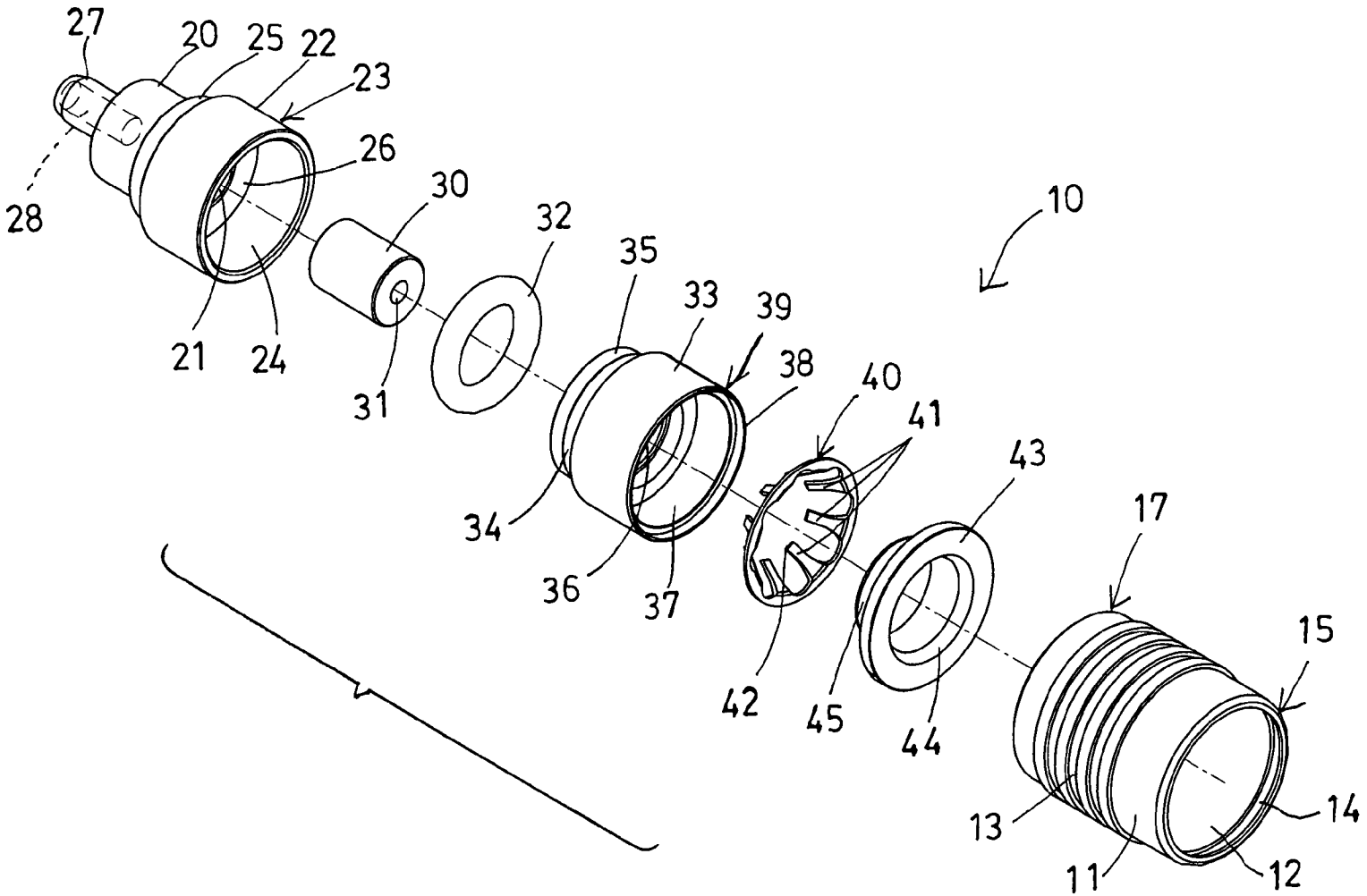
FIG. 2 is another partial exploded view illustrating one of the connector elements of the connector device.

Referring to the drawings, and initially to FIGS. 1-4, a connector device 1 in accordance with the present invention comprises two connector elements 10, 50 to be selectively plugged or coupled together for electrically connecting or coupling two pairs of conductors (not shown) together, and to be selectively disengaged from each other when required. The first or female connector element 10 includes an outer shell or ferrule 11 having a chamber 12 formed therein and having a rough or serrated outer peripheral surface 13 formed thereon for allowing the ferrule 11 to be frictionally held or grasped by the user and for allowing the ferrule 11 to be easily moved by the user.

The ferrule 11 includes an annular or peripheral recess 14 formed in the inner portion at one end portion 15 thereof, and includes a peripheral flange 16 extended radially and inwardly from the other end portion 17 thereof. The first connector element 10 further includes a receptacle 20 having a compartment 21 formed therein for snugly receiving or fitting an insulating member 30 therein, in which the insulating member 30 includes a bore 31 formed therein for receiving or fitting an inner conductor (not shown). The receptacle 20 includes an enlarged housing 22 formed or provided on one end portion 23 thereof, and includes an enlarged space 24 formed in the housing 22.

The housing 22 includes an outer diameter greater than that of the receptacle 20 for forming an annular or outer peripheral shoulder 25 between the housing 22 and the receptacle 20, and the space 24 of the housing 22 includes an inner diameter greater than that of the compartment 21 of the receptacle 20 for forming an annular or inner peripheral shoulder 26 between the housing 22 and the receptacle 20. The housing 22 further includes an extension 27 extended outwardly from the other end portion thereof or extended away from the housing 22, and includes a hole 28 formed in the extension 27 and aligned with the bore 31 of the insulating member 30, in which the hole 28 of the extension 27 includes an inner diameter smaller than that of the compartment 21 of the receptacle 20 for forming an annular or inner peripheral shoulder 29 between the extension 27 and the receptacle 20.

Figure 3:
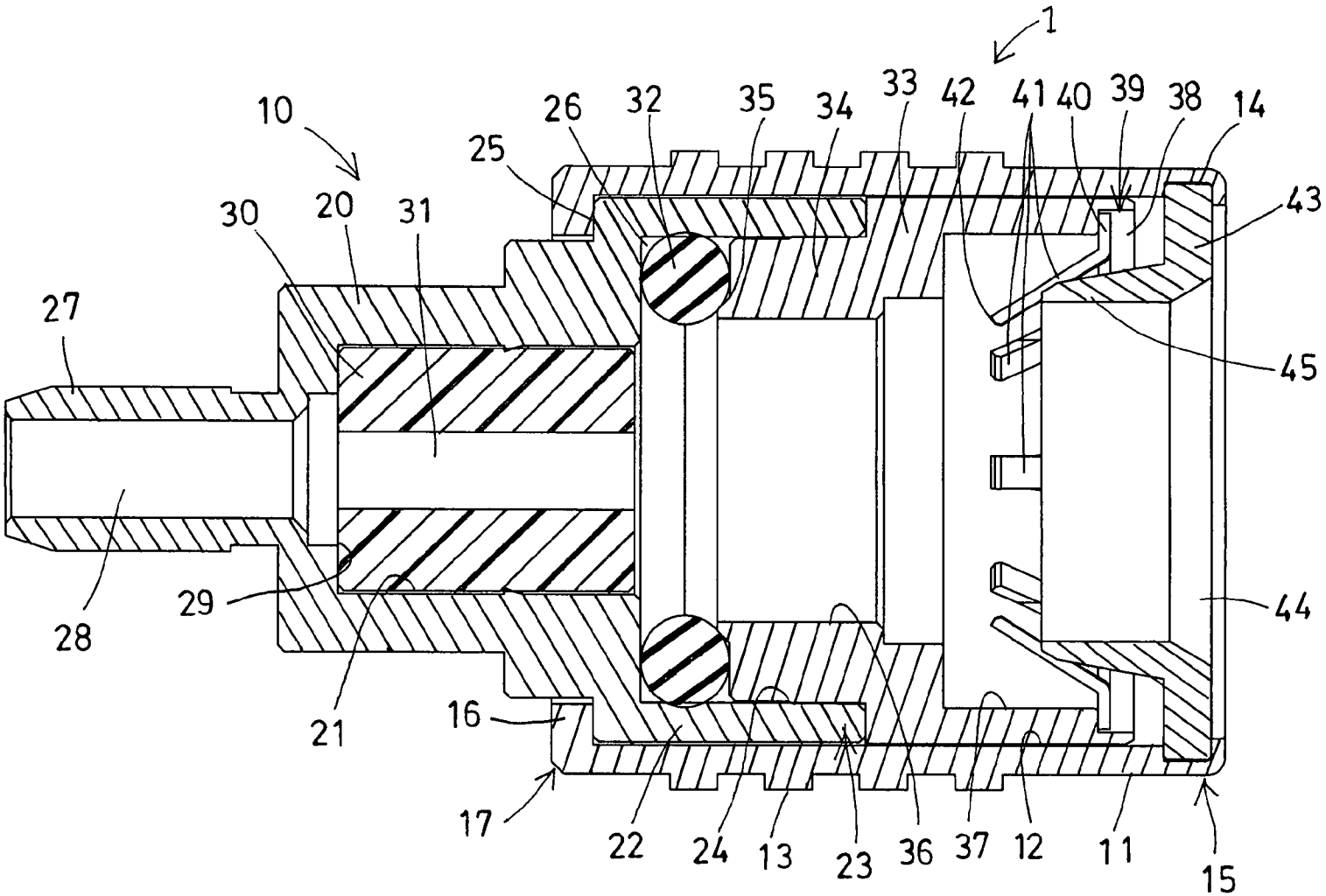
FIG. 3 is a cross sectional view of one of the connector elements of the connector device taken along lines 3-3 of FIG. 1.
Figure 4:
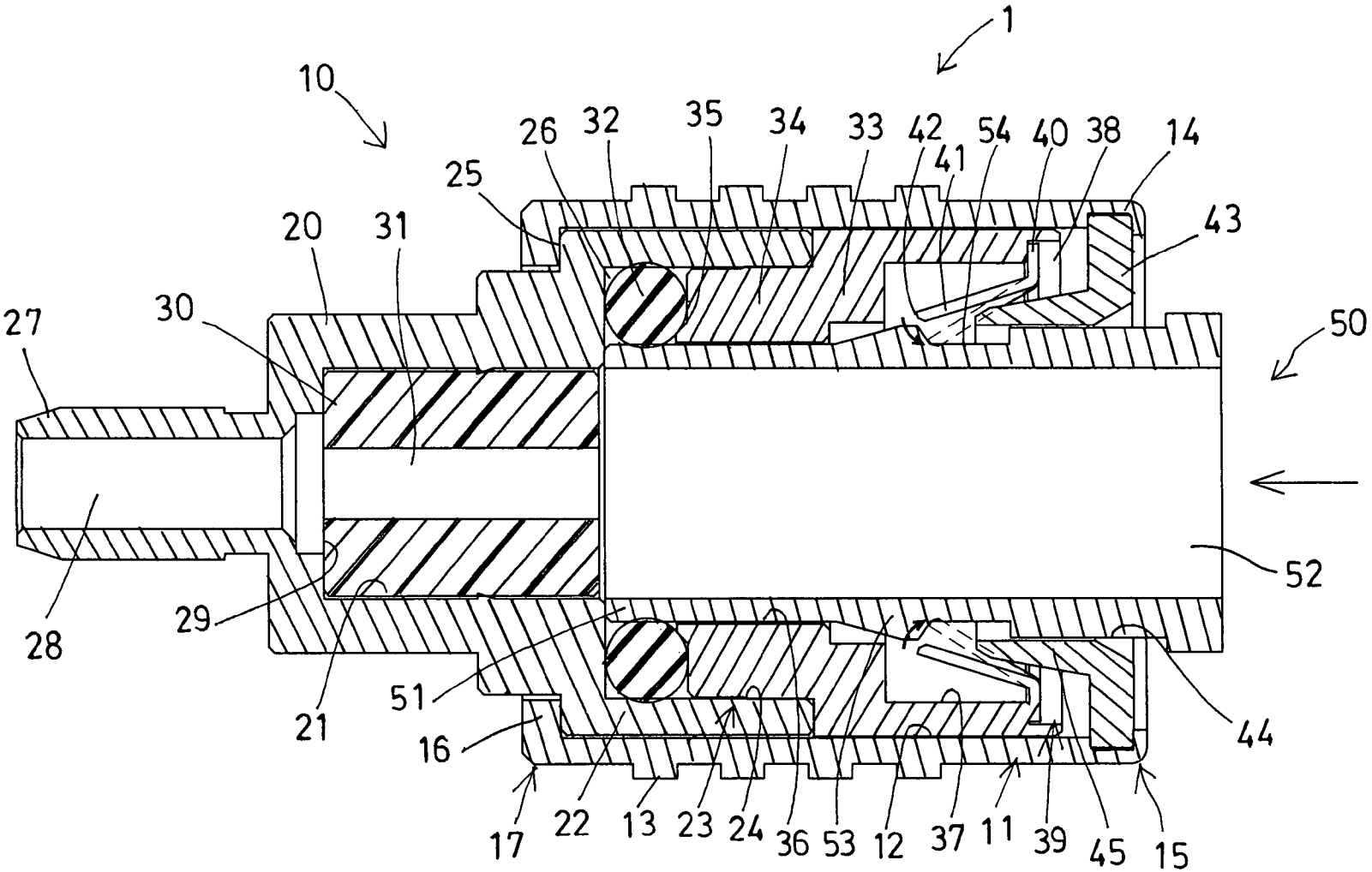
FIG. 4 is a cross sectional view similar to FIG. 3, illustrating the coupling or the connecting of the two connector elements of the connector device.
Figure 5:
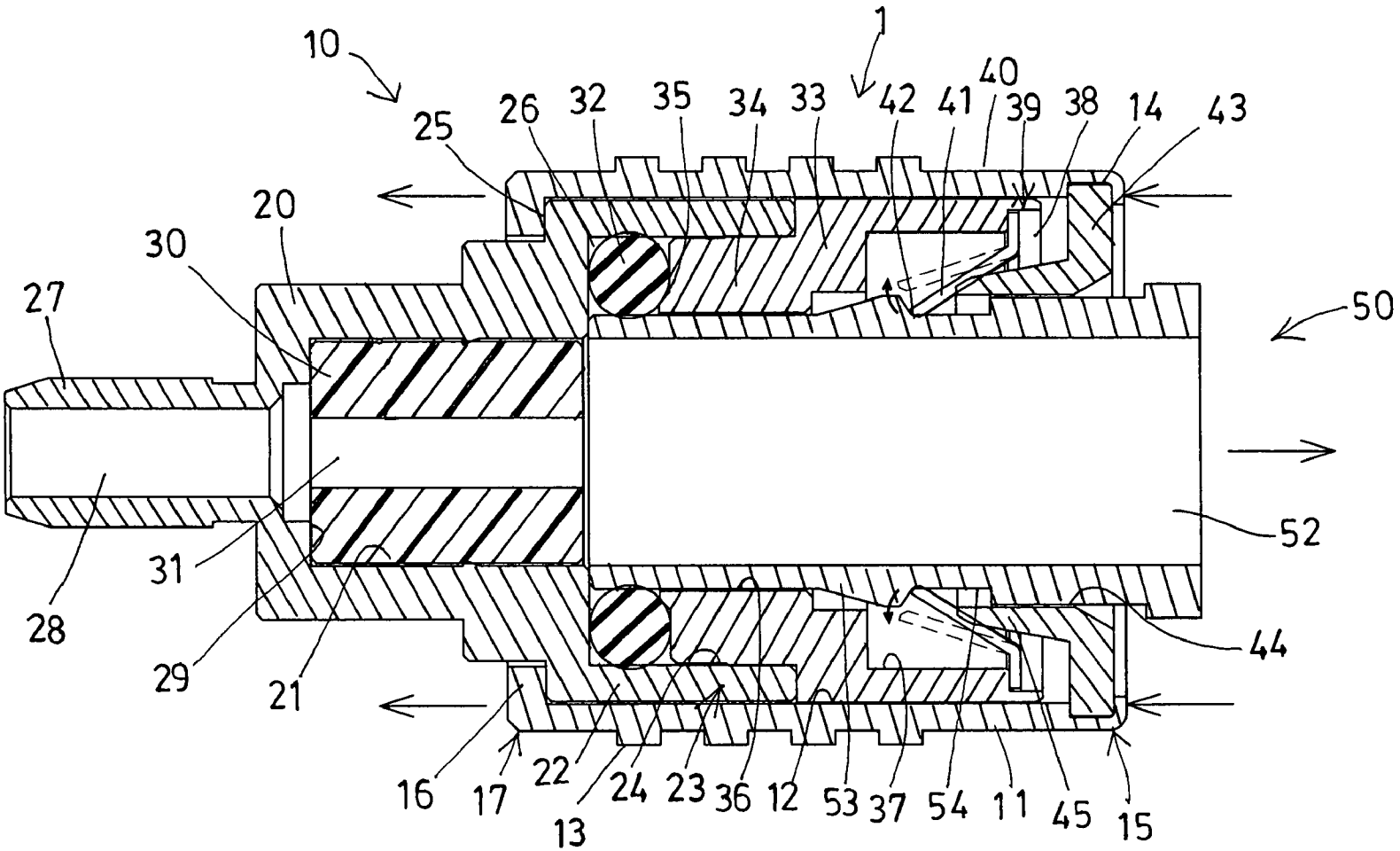
FIG. 5 is a cross sectional view similar to FIG. 4, illustrating the operation of the connector device.

As shown in FIGS. 3-5, the insulating member 30 is snugly received or fitted within the compartment 21 of the receptacle 20 and engaged with the inner peripheral shoulder 29 of the receptacle 20 for allowing the insulating member 30 to be stably anchored and retained within the compartment 21 of the receptacle 20. The hole 28 of the extension 27 may also be provided or used to receive or fit the inner conductor (not shown). The housing 22 of the receptacle 20 may be slidably engaged in the chamber 12 of the ferrule 11, and the peripheral flange 16 at the other end portion 17 of the ferrule 11 may be engaged with the outer peripheral shoulder 25 of the receptacle 20 or the housing 22 for limiting the ferrule 11 to slide or to move relative to the housing 22 and the receptacle 20.

A sealing ring 32 is received or fitted within the space 24 of the housing 22 and engaged with the inner peripheral shoulder 26 of the receptacle 20 for making an air or water tight seal between the housing 22 of the receptacle 20 and the second or male connector element 50. The first connector element 10 further includes a sleeve 33 received or fitted or engaged in the chamber 12 of the ferrule 11 and engaged with the housing 22 for stably anchoring and retaining the housing 22 within the chamber 12 of the ferrule 11, and the sleeve 33 includes one end portion 34 engaged in the space 24 of the housing 22, and includes a peripheral lip 35 extended from the one end portion 34 of the sleeve 33 for engaging with the sealing ring 32 and for stably anchoring and retaining the sealing ring 32 between the housing 22 of the receptacle 20 and the sleeve 33 and for preventing the sealing ring 32 from moving relative to the housing 22 of the receptacle 20 and the sleeve 33.

The sleeve 33 includes a reduced or relatively smaller chamber 36 formed in the one end portion 34 of the sleeve 33, and includes an increased or relatively greater chamber 37 and an annular or peripheral depression 38 formed in the other end portion 39 of the sleeve 33. A locking ring 40 is fitted or engaged in the peripheral depression 38 of the sleeve 33 or attached to the other end portion 39 of the sleeve 33 and anchored or secured to the sleeve 33 with a force-fitted engagement or fasteners or latches (not shown), or the like, and includes a number of fingers or blades 41 extended radially therefrom and inclined relative to the sleeve 33 and the locking ring 40, and includes an inclined surface 42 formed in the free end portion of each of the blades 41, and the blades 41 are provided for gripping or locking or retaining the second connector element 50 to the first connector element 10.

An actuating ring or member 43 is fitted or engaged in the peripheral recess 14 of the ferrule 11 or attached to the other end portion 15 of the ferrule 11, and anchored or secured to the ferrule 11 with a force-fitted engagement or fasteners or latches (not shown), or the like, and includes a bore 44 formed therein for receiving or fitting the second connector element 50, and includes a peripheral skirt or actuator 45 extended radially therefrom for engaging with the blades 41 of the locking ring 40 and for resiliently anchoring and retaining the sleeve 33 and the housing 22 within the chamber 12 of the ferrule 11, best shown in FIG. 3. The second connector element 50 includes a tubular member 51 engaged into the relatively smaller chamber 36 of the sleeve 33, and engageable with the inner peripheral shoulder 26 of the receptacle 20 for limiting the tubular member 51 of the second connector element 50 to slide or to move relative to the receptacle 20.

The tubular member 51 includes a compartment 52 formed therein for receiving or fitting another inner conductor (not shown) which may be engaged with the inner conductor of the receptacle 20, and the tubular member 51 may also be engaged with the sealing ring 32 for further stably anchoring and retaining the sealing ring 32 between the housing 22 of the receptacle 20 and the sleeve 33 and the tubular member 51. The tubular member 51 and the receptacle 20 and/or the sleeve 33 are made of conductive materials for forming or acting as the outer conductors 51, 20 and for selectively and electrically connecting or coupling the outer conductors 51, 20 together.

The tubular member 51 includes a peripheral tooth or bulge or swelling 53 extended radially and outwardly therefrom for engaging with the blades 41 of the locking ring 40 and for allowing the swelling 53 to be moved over the blades 41 (FIG. 4) and for allowing the blades 41 to selectively engage with the swelling 53 of the tubular member 51 and to latch or anchor the tubular member 51 to the receptacle 20 and the sleeve 33 of the first connector element 10. It is preferable that the tubular member 51 includes a peripheral recess 54 formed in the outer peripheral portion thereof and located beside the swelling 53 for stably receiving or engaging with the blades 41 of the locking ring 40 (FIG. 5).

In operation, as shown in FIG. 5, it is to be noted that the actuator 45 of the actuating member 43 is resiliently engaged with the blades 41 of the locking ring 40, and the actuating member 43 and the ferrule 11 may be moved relative to the locking ring 40 and the receptacle 20 and the sleeve 33 and the housing 22, and the actuator 45 of the actuating member 43 may move the blades 41 of the locking ring 40 radially and outwardly relative to the tubular member 51 and for allowing the swelling 53 of the tubular member 51 to be moved over the blades 41 and for allowing the tubular member 51 of the second connector element 50 to be selectively and quickly disengaged from the first connector element 10 when required.

It is further to be noted that the peripheral lip 35 of the sleeve 33 may be engaged with the sealing ring 32 for stably anchoring and retaining the sealing ring 32 between the tubular member 51 and the housing 22 of the receptacle 20 and the sleeve 33 and for preventing the sealing ring 32 from moving relative to the tubular member 51 and the housing 22 of the receptacle 20 and the sleeve 33. It is further to be noted that the actuating member 43 may be quickly fitted or engaged in the peripheral recess 14 of the ferrule 11 and anchored or secured to the ferrule 11 after the housing 22 of the receptacle 20 and the sleeve 33 have been fitted or engaged into the chamber 12 of the ferrule 11 such that the connector elements 10, 50 may be quickly coupled together and to be quickly disengaged from each other when required.

Figure 6:
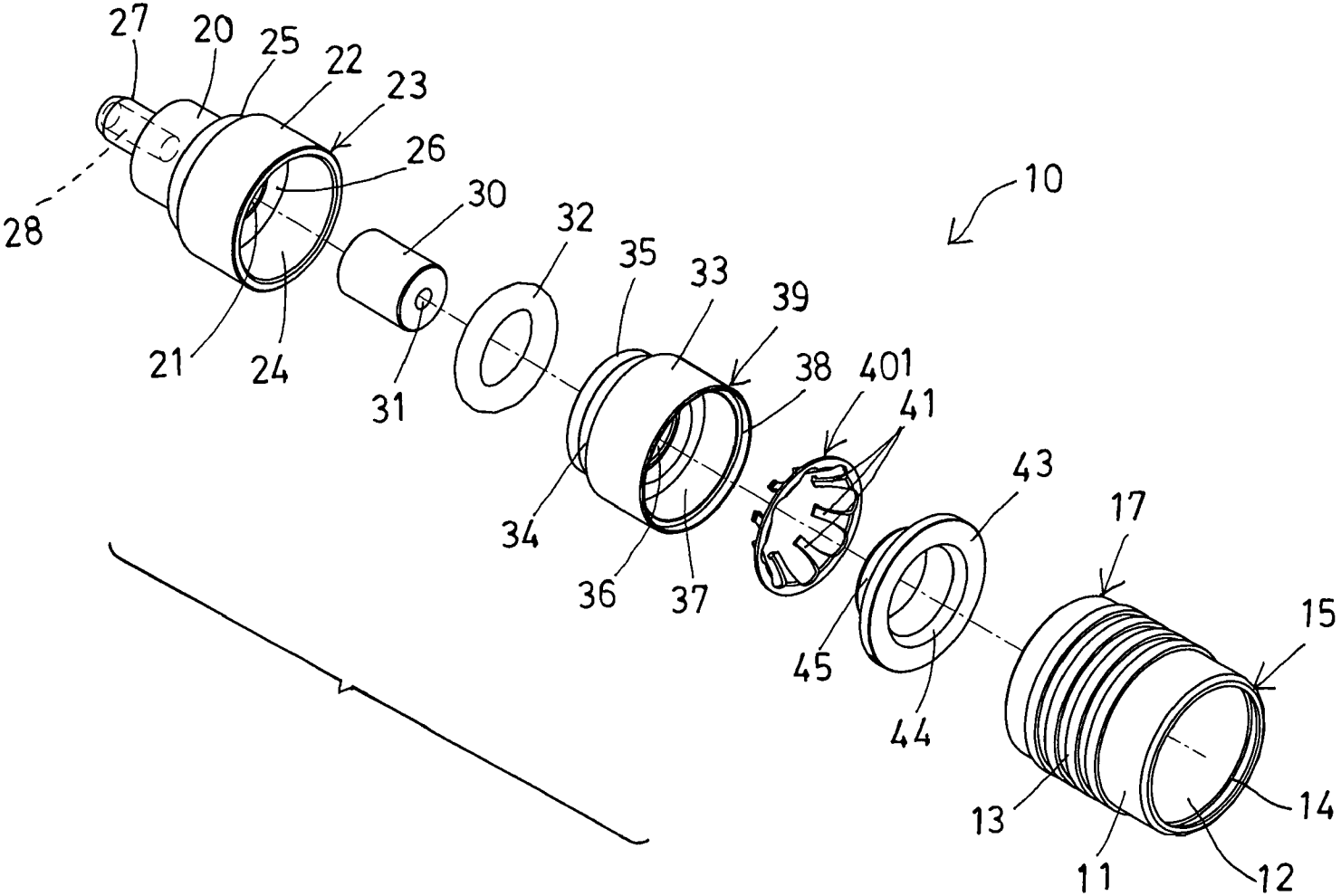
FIG. 6 is a further partial exploded view illustrating the other arrangement of one of the connector elements of the connector device.
Figure 7:
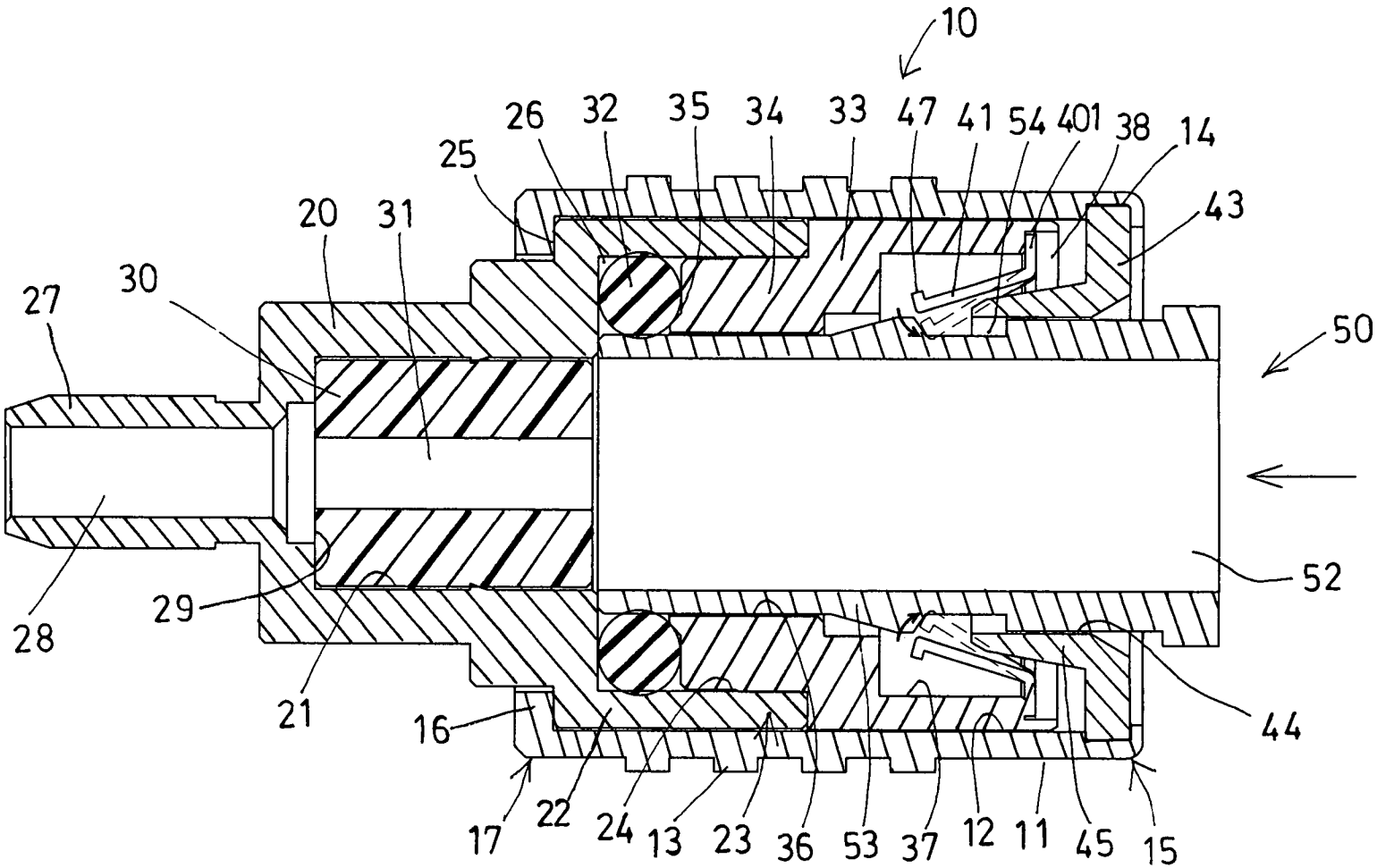
FIG. 7 is a cross sectional view illustrating the operation of the connector device as shown in FIG. 6.

Alternatively, as shown in FIGS. 6 and 7, the locking ring 401 may include a bent engaging member 47 formed or provided or disposed in the free end portion of each of the blades 41 for allowing the engaging members 47 of the blades 41 to be stably engaged with the swelling 53 of the tubular member 51 and to be stably retained in the peripheral recess 54 of the tubular member 51 after the swelling 53 is moved over the free end portions of the blades 41, and the blades 41 of the locking ring 401 may also be moved radially and outwardly relative to the tubular member 51 by the actuator 45 of the actuating member 43 for allowing the swelling 53 of the tubular member 51 to be moved over the blades 41 and for allowing the tubular member 51 of the second connector element 50 to be selectively and quickly disengaged from the first connector element 10.

Accordingly, the connector device in accordance with the present invention includes two connector elements to be quickly coupled together and to be quickly disengaged from each other when required.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A connector device comprising:

a first connector element including:

a ferrule having a chamber formed therein, and having a first end portion and a second end portion, a receptacle having a compartment formed therein, and having a housing provided on one end portion thereof, and having a space formed in said housing, said housing being fitted within said chamber of said ferrule, an insulating member received and fitted in said compartment of said receptacle and including a bore formed in said insulating member, a sealing ring fitted in said space of said housing and engaged with said housing and said receptacle, a sleeve received and fitted in said chamber of said ferrule and engaged with said housing for anchoring and retaining said housing within said chamber of said ferrule, and including a peripheral lip extended from a first end portion of said sleeve to engage with said sealing ring and to anchor and retain said sealing ring between said housing and said sleeve, and said sleeve including a second end portion, a locking ring attached to said second end portion of said sleeve and including a plurality of blades extended therefrom and inclined relative to said sleeve, and an actuating member attached to said second end portion of said ferrule, and including an actuator extended radially therefrom for engaging with said blades of said locking ring and for anchoring and retaining said sleeve and said housing within said chamber of said ferrule, and a second connector element including a tubular member engaged into said sleeve and engageable with said receptacle for limiting said tubular member to move relative to said receptacle, and engaged with said sealing ring, said tubular member including a swelling extended radially and outwardly therefrom for engaging with said blades and for allowing said swelling to be moved over said blades and for allowing said blades to selectively engage with said swelling of said tubular member and to latch and anchor said tubular member to said receptacle and said sleeve, and said ferrule and said actuating member being movable relative to said sleeve and said housing to actuate said actuator of said actuating member to move said blades radially and outwardly relative to said tubular member and to allow said swelling of said tubular member to be moved over said blades and to allow said tubular member to be selectively disengaged from said sleeve and said housing of said first connector element.

2. The connector device as claimed in claim 1, wherein said ferrule includes a peripheral flange extended radially and inwardly from said first end portion of said ferrule for engaging with said housing and for limiting said ferrule to move relative to said housing.

3. The connector device as claimed in claim 2, wherein said housing includes an outer diameter greater than that of said receptacle for forming an outer peripheral shoulder between said housing and said receptacle and for engaging with said peripheral flange of said ferrule.

4. The connector device as claimed in claim 1, wherein said housing includes an extension extended outwardly therefrom and having a hole formed in said extension and aligned with said bore of said insulating member.

5. The connector device as claimed in claim 1, wherein said sleeve includes a peripheral depression formed in said second end portion of said sleeve for attaching said locking ring.

6. The connector device as claimed in claim 1, wherein said ferrule includes a peripheral recess formed in said second end portion of said ferrule for attaching said actuating member.

7. The connector device as claimed in claim 1, wherein said locking ring includes an inclined surface formed in a free end portion of each of said blades for engaging with swelling of said tubular member.

8. The connector device as claimed in claim 1, wherein said tubular member includes a peripheral recess formed in an outer peripheral portion thereof and located beside said swelling for receiving and engaging with said blades of said locking ring.

* * * * *